United States Patent [19]

Howard et al.

[11] Patent Number: 4,715,078

[45] Date of Patent: Dec. 29, 1987

[54] PAPERBOARD EDGE BUFFER AND CLEANER

[75] Inventors: Paul C. Howard, Downey, Calif.; Ed Nowaczek, Boulder, Colo.

[73] Assignee: Web Systems, Inc., Boulder, Colo.

[21] Appl. No.: 708,946

[22] PCT Filed: Jun. 20, 1983

[86] PCT No.: PCT/US83/00924

§ 371 Date: Mar. 11, 1985

§ 102(e) Date: Mar. 11, 1985

[87] PCT Pub. No.: WO84/02067

PCT Pub. Date: Jun. 7, 1984

[51] Int. Cl.[4] ..... A46B 13/00

[52] U.S. Cl. ..... 15/4; 134/1; 134/6; 134/21; 15/77; 15/89; 15/94; 15/308; 15/309

[58] Field of Search ..... 134/6, 15, 21, 1; 15/300 R, 308, 309, 306 A, 306 R, 316 R, 405, 4, 102, 1.5, 77, 89

[56] References Cited

U.S. PATENT DOCUMENTS

| | | | |
|---|---|---|---|
| 2,881,570 | 4/1959 | Moore et al. | 15/77 |
| 2,920,987 | 1/1960 | Landry et al. | 15/77 |
| 4,129,919 | 12/1978 | Fitch et al. | 15/302 |
| 4,198,061 | 4/1980 | Dunn | 15/306 R |
| 4,364,147 | 12/1982 | Biedermann et al. | 15/405 |
| 4,486,238 | 12/1984 | Bando | 134/6 |

*Primary Examiner*—Helen M. S. Sneed
*Assistant Examiner*—Sharon T. Cohen
*Attorney, Agent, or Firm*—Norman E. Carte

[57] ABSTRACT

A Paperboard Edge Buffer And Cleaner for buffing the edges of cut paperboard and then cleaning the paperboard's surfaces and edges.

The Paperboard Edge Buffer And Cleaner is comprised of an upper buffing roller 28 which buffs the leading and upper surface of the paperboard and a lower buffer roller 29 which buffs the trailing edge and lower surface of the paperboard. An upper paperboard vacuum duct 34 and a lower paperboard vacuum duct 35 cooperate with an upper pressure duct 36 and a lower pressure duct 37 to clean the paperboard.

An ion generator 73 and 74 may be mounted within each pressure duct 36 and 37 to reduce the electrostatic forces which cause particles to cling to the surface of the paperboard.

A source of ultrasonic energy 75 and 76 may be likewise mounted within each pressure duct 36 and 37 to help loosen particles clinging to the surface of the paperboard.

10 Claims, 11 Drawing Figures

PAPERBOARD EDGE BUFFER AND CLEANER

This application is a continuation in part of application Ser. No. PCT/US82/01649 filed 29 Nov. 1982.

TECHNICAL FIELD

This invention relates to paperboard handling apparatus and more particularly to such apparatus which buff and clean the edges and surfaces of cut paperboard.

BACKGROUND ART

Paperboard, generally in thicknesses of 0.010 to 0.042 inch (0.25 to 1.07 millimeter), is widely utilized in the manufacture of small folding paper cartons, phonograph record jackets, blister pack packaging cards, and the like. The paperboard is supplied in continuous rolls which must be cut to the proper length and width for each application. This cutting leaves the edges coarse and covered with particles from the paperboard's clay coating.

These particles are often as large as ⅛ inch (3.2 millimeters) across. They cling to the cut edge of the paperboard and may be held in place by paper fibers. The particles may later come loose and find their way to either surface of the paperboard where they cause problems when an attempt is made to print upon that surface of the paperboard.

Particles as small as 1.38 thousandths of an inch (35 microns) must not be allowed to remain upon the surfaces of the paperboard which are to be printed upon. A particle of this size which finds its way to the print blanket of an offset printing press can cause a blemish upon the printed surface of the paperboard which is 1.97 thousandths of an inch (50 microns) wide. Since the human eye can detect blemishes as small as 1.97 thousandths of an inch (50 microns), particles down to this size must be removed prior to printing upon the surface of the paperboard.

Particles smaller than 1.38 thousandths of an inch (35 microns) are less important, but still significant. These are the most numerous particles and are the first to collect on the print blanket, giving it a hazy appearance even though the individual particles are invisible to the eye. The accretion of fine particles on the print blanket can cause non-uniformity in the printing of large color fields. Further, an agglomeration of fine particles can grow large enough to cause visible blemishes. It is desirable to limit the accretion of fine particles on the print blanket by removing them from the surface of the paperboard.

Conventional vacuums, vacuum brushes, and airknives provide very little cleaning in the range below 2.76 thousandths of an inch (70 microns).

A prior art search did not disclose any patents for devices which treat the edges of paperboard in the manner of the present invention. The following patent documents were considered in the investigation and evaluation of the prior are relative to this invention.

| PATENT NUMBER | INVENTOR | ISSUE DATE |
|---|---|---|
| 1,591,167 (Britain) | Bleasdale | 17 June 1981 |
| 4,129,919 (U.S.) | Fitch et al | 19 Dec. 1978 |
| 3,117,333 (U.S.) | Murray et al | 14 Jan. 1964 |

The Bleasdale patent discloses an apparatus for removing the photographic emulsion from microfilm. It is concerned with treating the upper and lower surfaces of the microfilm and not the edges.

The Murray patent discloses an apparatus which uses rotating brushes to remove dust from microfilm frames mounted in data storage cards. This device only cleans the upper and lower surfaces of the microfilm.

The Fitch patent discloses an apparatus for scrubbing and drying the upper and lower surfaces of printed circuit boards.

The above mentioned devices are directly concerned with treating the upper and lower surfaces of their respective working materials, whereas the present invention buffs and cleans all four of the edges of its working material as well as the upper and lower surfaces where required.

DISCLOSURE OF THE INVENTION

It is an object of this invention to provide a Paperboard Edge Buffer And Cleaner which buffs the cut edges of paperboard and removes the residue of the cutting and buffing processes.

Another object of this invention is to provide a Paperboard Edge Buffer And Cleaner which is capable of buffing the upper and lower surfaces of the paperboard and which has interchangeable buffing rollers to provide a variety of finishes.

Yet another object of this invention is to provide a Paperboard Edge Buffer And Cleaner which can be installed in an existing paperboard handling machine at a point just after the cutter and just prior to the stacker with a minimum of modification to the existing machinery.

These objects are attained through the use of two buffing rollers which are strategically located in the path of the paperboard. A first buffing roller contacts the forward edge of the paperboard as the paperboard travels away from the cutter. As the paperboard continues to move forward its upper surface is also buffed by the same roller.

A second buffing roller buffs the trailing edge of the paperboard as it continues along its path toward the stacker. This roller can also be used to buff the underside of the paperboard.

Both buffing rollers also buff the left and right edges of the paperboard as the paperboard passes by these buffing rollers.

A vacuum system removes the particles which collect on the buffing rollers and also cleans all four edges and both the upper and lower surfaces of the paperboard.

A pressure system removes the particles from the paperboard's surface so that the vacuum system may readily transport them away An ion generator such as the commercial static bar may be utilized to introduce ions onto both surfaces of the paperboard to neutralize static charges which cause the particles to cling to the paperboard, thereby increasing the effectiveness of particle removal by the pressure system. The ion generator may be located inside the pressure duct.

An ultrasonic generator may be incorporated into the pressure system to superimpose high frequency pressure waves on the pressure system air flow. These pressure waves facilitate the removal of small particles from the paperboard's surface, especially fine particles smaller than 1.38 thousandths of an inch (35 microns).

BEST MODE FOR CARRYING OUT THE INVENTION

Figure 1:
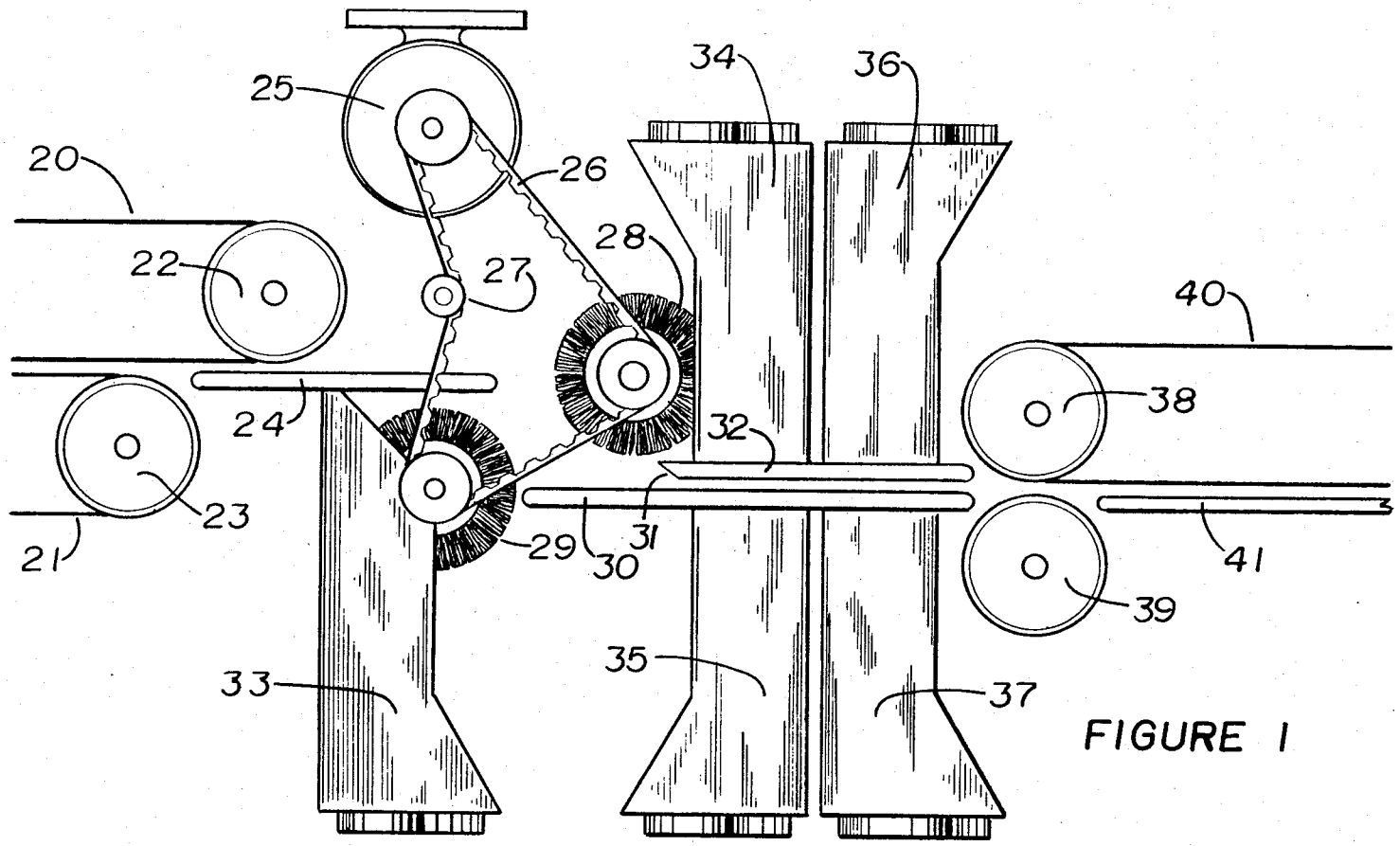
FIG. 1 is a side view of the Paperboard Edge Buffer.

As can be seen in FIG. 1, an upper feed tape 20 and a lower feed tape 21 cooperate with an upper high speed tape roller 22 and a lower high speed tape roller 23 to deliver paperboard to a long upper platform 24.

A motor 25 drives a belt 26 which is kept tight by an adjustable idler pulley 27. The belt 26 drives an upper buffing roller 28 and a lower buffing roller 29.

Figure 2:
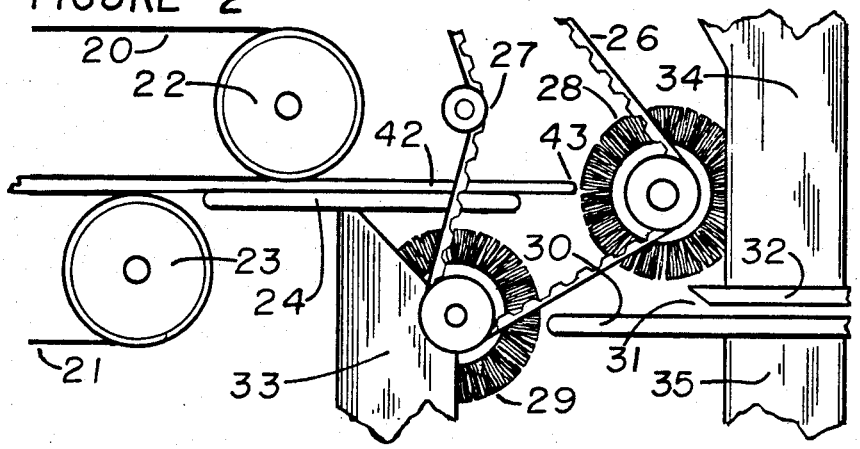
FIG. 2 is a fragmentary side view of the Paperboard Edge Buffer with the long upper platform installed and a piece of paperboard having its leading edge buffed.

As shown in FIG. 2, after the paperboard 42 passes over the long upper platform 24, the leading edge of the paperboard 43 contacts the upper buffing roller 28. The upper buffing roller 28 is rotating counterclockwise as viewed in FIG. 2 and therefore it forces the leading edge of the paperboard 43 downward toward the lower platform 30.

Figure 3:
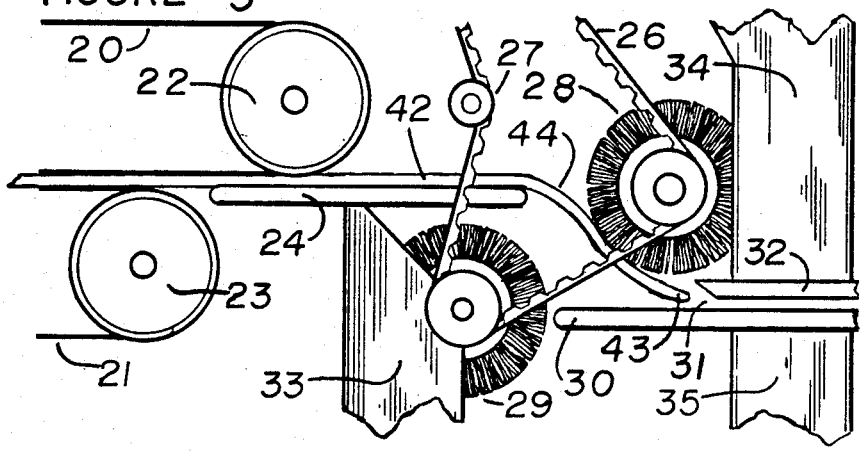
FIG. 3 is a fragmentary side view of the Paperboard Edge Buffer with the long upper platform installed showing a piece of paperboard having its upper surface buffed.

FIG. 3 shows the paperboard 42 after it has been forced downward toward the lower platform 30. The forward edge of the paperboard 43 is about to enter the paperboard guide 31. As the paperboard 42 travels from the long upper platform 24 to the lower platform 30, its upper surface 44 is buffed by the upper buffing roller 28.

Figure 4:
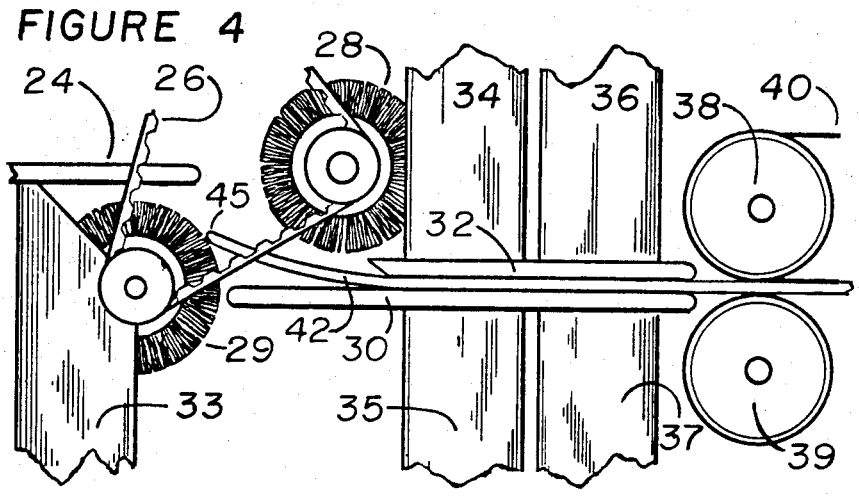
FIG. 4 is a fragmentary side view of the Paperboard Edge Buffer with the long upper platform installed showing a piece of paperboard having its trailing edge buffed.

As shown in FIG. 4, the trailing edge of the paperboard 45 is buffed by the lower buffing roller 29 as it drops from the long upper platform 24. The lower buffing roller rotates counterclockwise as viewed in FIG. 4.

Figure 8:
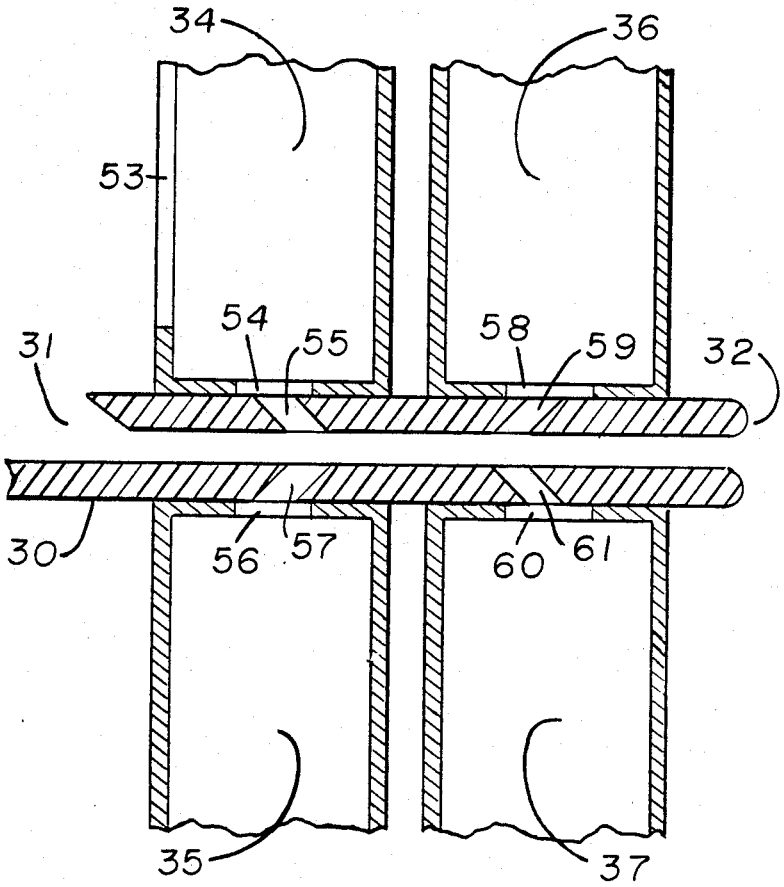
FIG. 8 is a fragmentary sectional side view of the pressure and vacuum ducts showing the orifices through which they operate.

After the paperboard 42 passes through the paperboard guide 31 it travels between an upper paperboard vacuum duct 34 and a lower paperboard vacuum duct 35. These ducts are best shown in FIG. 1. A vacuum means, not shown, operates through orifice 54 in the upper paperboard vacuum duct 34 and orifice 55 in the upper vacuum platform 32 as shown in FIG. 8. The vacuum means also operates through orifice 56 in the lower paperboard vacuum duct 35 and orifice 57 in the lower platform 30. The vacuum system draws particles which remain on the paperboard 42 into orifices 55 and 57.

The pressure in the upper paperboard vacuum duct 34 is maintained at a slightly higher level than the pressure in lower paperboard vacuum duct 35 so that the paperboard 42 is forced down against the lower platform 30. This insures that the upper surface of the paperboard 44 is not abraded by the upper vacuum platform 32. This is important since it is the upper surface of the paperboard 44 upon which printing is most likely to occur. Therefore a smooth unblemished upper surface is desirable.

Also shown in FIG. 8 are the upper pressure duct 36 and the lower pressure duct 37. The upper pressure duct 36 operates through orifice 58 in the upper pressure duct 36 and orifice 59 in the upper vacuum platform 32. The lower pressure duct 37 operates through orifice 60 in the lower pressure duct 37 and orifice 61 in the lower platform 30.

The upper pressure duct 36 and the lower pressure duct 37 blow air upon their respective surfaces of the paperboard 42 to remove the particles not removed by the buffing rollers 28 and 29 and thereby allow the vacuum system to transport them.

The pressure in the upper pressure duct 36 is maintained at a slightly higher level than the pressure in the lower pressure duct 37 for the reason mentioned above.

As best shown in FIG. 1, an upper high speed receiver tape roller 38 in cooperation with a lower high speed contact roller 39 and a high speed receiver tape 40 are used to to pull the paperboard 42 (best shown in FIG. 4) from between the upper vacuum platform 32 and the lower platform 30. The paperboard 42 is pulled onto an exit platform 41 from which it may travel on to the stacker.

Figure 5:
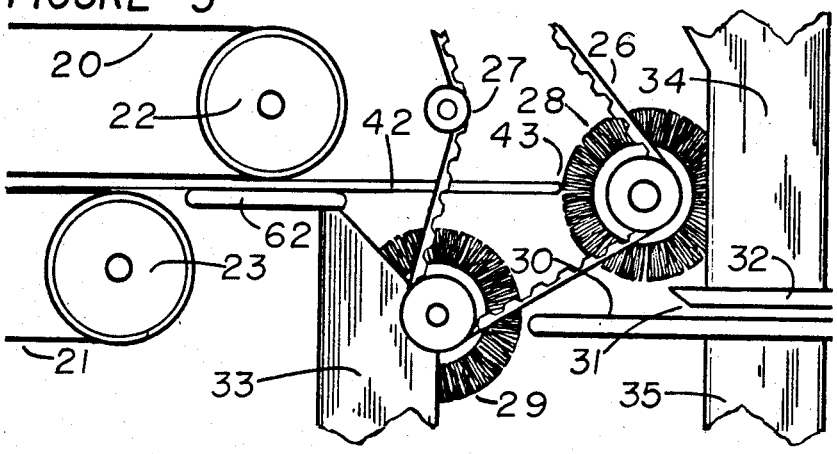
FIG. 5 is a fragmentary side view of the Paperboard Edge Buffer with the short upper platform installed showing a piece of paperboard having its leading edge buffed.
Figure 6:
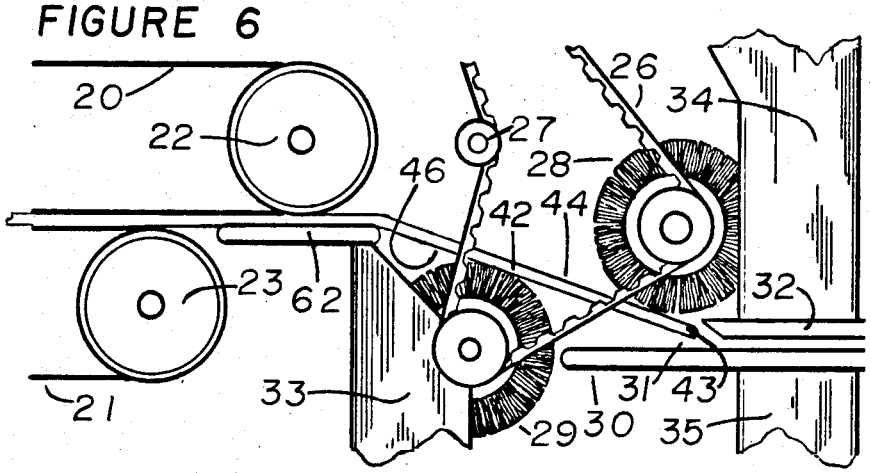
FIG. 6 is a fragmentary side view of the Paperboard Edge Buffer with the short upper platform installed showing a piece of paperboard having its upper and lower surfaces buffed.
Figure 7:
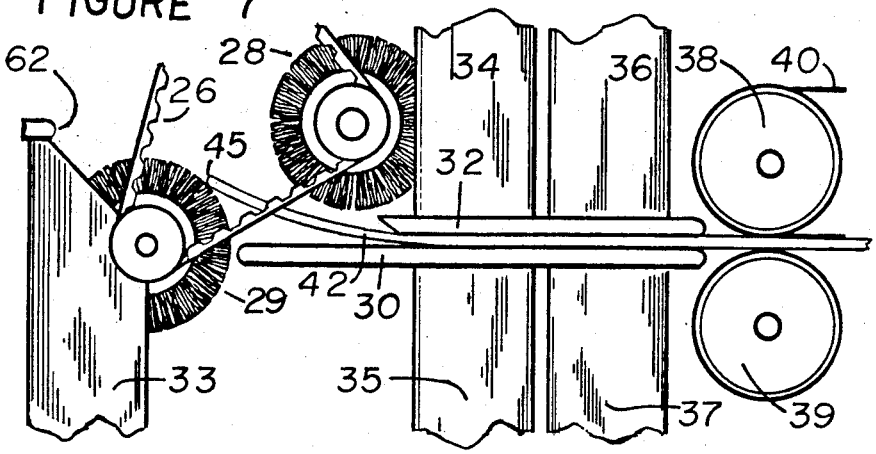
FIG. 7 is a fragmentary side view of the Paperboard Edge Buffer with the short upper platform installed showing a piece of paperboard having its trailing edge buffed.

If it is desired that the lower surface of the paperboard be buffed also, then the long upper platform 24 is removed and replaced with a short upper platform 62 as shown in FIGS. 5, 6, and 7.

FIG. 5 shows the paperboard 42 as its forward edge 43 is buffed in much the same manner as when the long upper platform 24 is installed.

FIG. 6 shows the paperboard 42 as it is forced downward by the upper buffing roller 28. The lower buffing roller 29 now buffs the lower surface of the paperboard 46 while the upper buffing roller 28 buffs the upper surface of the paperboard 44.

FIG. 7 shows the paperboard 42 as its trailing edge 45 is buffed by the lower buffing roller 29 in much the same manner as when the long upper platform 24 is installed.

Figure 9:
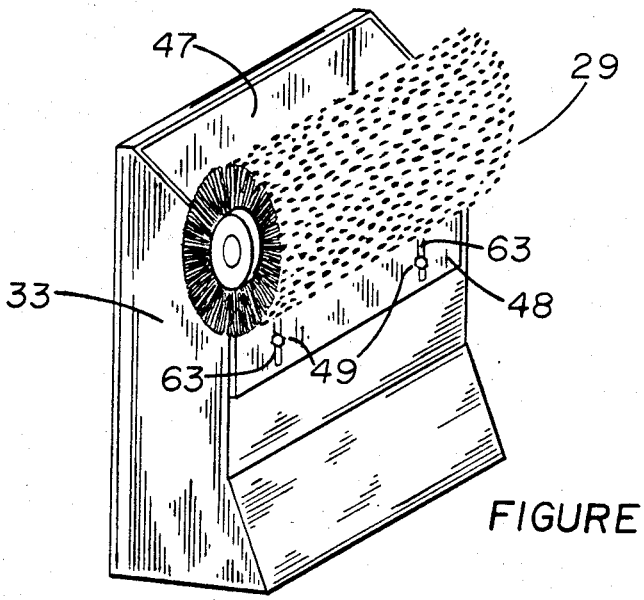
FIG. 9 is a perspective view of the lower buffer vacuum duct with the lower buffing roller.

FIG. 9 shows the lower buffer vacuum duct 33 and the lower buffing roller 29 removed from the remainder of the Paperboard Edge Buffer. The lower buffer vacuum duct 33 is connected to the vacuum means to remove particles from the lower buffing roller 29. The lower buffing roller 29 enters the lower buffer vacuum duct 33 through orifice 47.

A lower buffer vacuum duct plate 48 is provided to restrict airflow along the lower edge of the buffing roller 29. This plate 48 is adjustable by operation of adjustment screws 49 in slots 63.

The plate 48 also provides a means for maintaining even wear on the lower buffing roller 29. Since different widths of paperboard may be buffed and since the smaller widths of paperboard will travel along the center of the path through the Paperboard Edge Buffer, the area near the middle of the buffing rollers will tend to wear faster than the area at the ends of the buffing rollers. The plate 48 therefore provides a means for introducing wear on the ends of the lower buffing roller 29, thereby maintaining even wear across the surface of the lower buffing roller 29.

Figure 10:
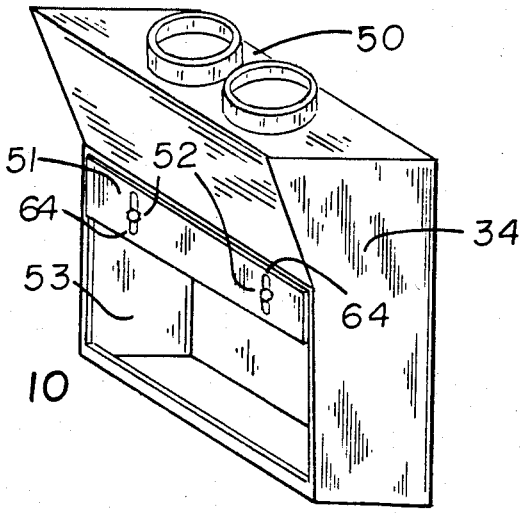
FIG. 10 is a perspective view of the upper paperboard vacuum duct.

FIG. 10 shows the upper paperboard vacuum duct 34 with the upper buffing roller 28 removed. In addition to removing particles from the upper surface of paperboard, the upper paperboard vacuum duct 34 also removes particles from the upper buffing roller 28. The upper buffing roller 28 enters the upper paperboard vacuum duct 34 through orifice 53.

Like the lower buffer vacuum duct 33, the upper paperboard vacuum duct also has a plate 51 which is adjustable by screws 52 in slots 64. This plate 51 serves the same purpose as the plate 48 in the lower buffer vacuum duct 33. The ports 50 by which the upper paperboard vacuum duct 34 is connected to the vacuum means are shown in FIG. 10.

Figure 11:
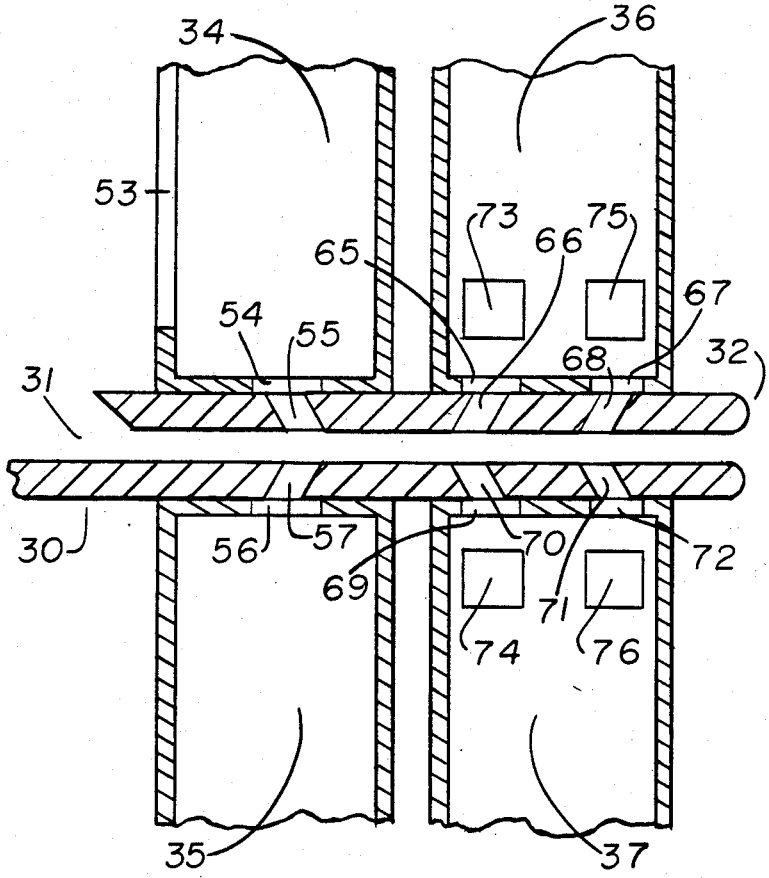
FIG. 11 is a fragmentary sectional side view of the pressure and vacuum ducts showing an additional orifice in each pressure duct and an ion generator and an ultrasonic generator in each pressure duct.

FIG. 11 shows the addition of an ion generator 73 and 74 in each of the two pressure ducts 36 and 37. An orifice 65 in the upper pressure duct 36 in cooperation with an orifice 66 in the upper vacuum platform 32 provides ionized air to the upper surface of the paperboard.

An orifice 69 in the lower pressure duct 37 in cooperation with an orifice 70 in the lower platform 30 provides ionized air to the lower surface of the paperboard.

The ion generators 73 and 74 provide ions to both surfaces of the paperboard to neutralized charges which cause particles to cling to the paperboard, thereby making it easier for the pressurized airflow to remove the particles.

Also shown in FIG. 11 is the addition of an ultrasonic generator 75 and 76 in each of the two pressure ducts 36 and 37. An orifice 67 in the upper pressure duct 36 in cooperation with an orifice 68 in the upper vacuum platform 32 provides ultrasonic energy to the upper surface of the paperboard.

An orifice 72 in the lower pressure duct 37 in cooperation with an orifice 71 in the lower platform 30 provides ultrasonic to the lower surface of the paperboard.

The ultrasonic generators 75 and 76 operate through the pressure duct orifices 67 and 72 to provide ultrasonic energy to the upper and lower surfaces of the paperboard. This helps remove particles clinging to the paperboard.

The acoustic energy may be generated by any of the means presently available, such as piezoelectric transducers or acoustically tuned chambers. It is preferably of a frequency or frequencies outside the audible range to prevent noise exposure to people nearby. The higher frequencies and resulting shorter acoustic wavelengths facilitate the transfer of energy to the smaller particles on the paperboard's surface, thereby enhancing their removal.

Although the invention has been described in complete detail and shown in the accompanying drawings, it is not intended that it be limited to such details since modifications may be made without departing from the spirit and scope thereof. Therefore, the Paperboard Edge Buffer And Cleaner as disclosed is intended to cover all equivalents and modifications falling within the scope of the claims.

We claim:

1. A Paperboard Edge Buffer and Cleaner comprising:

(a) a first buffing roller for buffing the leading edge of paperboard; said first buffing roller is disposed relative to the paperboard transport means so as to buff the upper surface of the paperboard in addition to the leading edge of the paperboard, (b) a second buffing roller disposed near said first buffing roller for buffing the trailing edge of the paperboard, said second buffing roller is disposed relative to the paperboard transport means so as to buff the lower surface of the paperboard in addition to the trailing edge of the paperboard, (c) a first vacuum means for removing particles remaining on the paperboard after the paperboard passes by said first and second buffing rollers, (d) a pressure means for removing the particles to facilitate their transport by the vacuum means, (e) a second vacuum means for removing particles from said first and second buffing rollers, (f) a transport means for moving the paperboard into contact with said first buffing roller and said second buffing roller, (g) a pair of interchangeable platforms, the first of said platforms being of such length as to cause the paperboard to pass over said second buffing roller without having said paperboard lower surface buffed, yet having the trailing edge buffed, and the second of said platforms being of such length as to cause the paperboard to pass over said second buffing roller and to have said paperboard lower surface buffed in addition to having the trailing edge buffed, and (h) a plate means for causing the buffing rollers to wear evenly across their surfaces.

2. A Paperboard Edge Buffer And Cleaner according to claim 1 wherein said first and second buffing rollers are disposed relative to the paperboard transport means so as to buff the left and right edges of the paperboard in addition to the leading and trailing edges of the paperboard.

3. A Paperboard Edge Buffer And Cleaner according to claim 2 wherein the vacuum means for removing particles on the paperboard is comprised of an upper and a lower vacuum duct which operate through orifices to remove particles from their respective surfaces of the paperboard.

4. A Paperboard Edge Buffer And Cleaner according to claim 3 wherein the pressure means is comprised of an upper and a lower pressure duct which operate through orifices to remove particles from the surface to facilitate their transport by the vacuum means.

5. A Paperboard Edge Buffer And Cleaner according to claim 4 wherein the plate means for causing the buffing rollers to wear evenly across their surface is an adjustable plate which contacts said buffing rollers along their entire length and also provides a seal for the vacuum ducts in which they are mounted.

6. A paperboard edge buffer and cleaner according to claim 1 further comprising one or more ion generators to neutralize the electrostatic charges which cause the particles to cling to the paperboard, allowing particle removal by the pressure means.

7. A Paperboard Edge Buffer And Cleaner according to claim 6 wherein one or more ultrasonic sources are contained inside the pressure duct.

8. A Paperboard Edge Buffer and Cleaner comprising:

(a) a first buffing roller for buffing the leading edge of paperboard; said first buffing roller is disposed relative to the paperboard transport means so as to buff the upper surface of the paperboard in addition to the leading edge of the paperboard, (b) a second buffing roller disposed near said first buffing roller for buffing the trailing edge of the paperboard, said second buffing roller is disposed relative to the paperboard transport means so as to buff the lower surface of the paperboard in addition to the trailing edge of the paperboard, (c) a first vacuum means for removing particles remaining on the paperboard after the paperboard passes by said first and second buffing rollers, comprised of an upper and a lower vacuum duct which operate through orifices to remove particles from their respective surfaces of the paperboard, (d) a pressure means for removing the particles to facilitate their transport by the vacuum means, comprised of an upper and a lower pressure duct which operate through orifices to remove particles from the surface to facilitate their transport by the vacuum means, (e) a second vacuum for removing particles from said first and second buffing rollers, (f) a transport means for moving the paperboard into contact with said first buffing roller and said second buffing roller, (g) a pair of interchangeable platforms, the first of said platforms being of such length as to cause the paperboard to pass over said second buffing roller without having said paperboard lower surface buffed, yet having the trailing edge buffed, and the second of said platforms being of such length as to cause the paperboard to pass over said second buffing roller and to have said paperboard lower surface buffed in addition to having the trailing edge buffed, said first and second buffing rollers are disposed relative to the paperboard transport means so as to buff the left and right edges of the paperboard in addition to the leading and trailing edges of the paperboard, (h) a plate means for causing the buffing rollers to wear evenly across their surfaces, and (i) one or more ultrasonic sources which are utilized to help remove particles clinging to the paperboard, said sources are contained inside the pressure duct and direct their acoustic energy substantially through one or more of the pressure duct orifices to the surface of the paperboard, said sources further provide acoustic energy at one or more frequencies outside the audible range.

9. A Paperboard Edge Buffer And Cleaner according to claim 8 wherein one or more ultrasonic sources are contained inside the pressure duct and direct their acoustic energy substantially through one or more of the pressure duct orifices to the surface of the paperboard.

10. A Paperboard Edge Buffer And Cleaner according to claim 9 wherein one or more ultrasonic sources provide acoustic energy at one or more frequencies outside the audible range.

* * * * *